US005752864A

United States Patent [19]

Jones et al.

[11] Patent Number: 5,752,864

[45] Date of Patent: May 19, 1998

[54] REVERSE GATE FOR PERSONAL WATERCRAFT

[75] Inventors: James R. Jones, Neosho; Peter P. Grinwald, Rubicon; Richard P. Christians, Appleton, all of Wis.

[73] Assignee: Brunswick Corporation, Lake Forest, Ill.

[21] Appl. No.: 783,440

[22] Filed: Jan. 16, 1997

[51] Int. Cl.[6] ..... B63H 11/11

[52] U.S. Cl. ..... 440/41; 440/42

[58] Field of Search ..... 440/38, 39, 40, 440/41, 42, 43, 44, 45, 46, 47

[56] References Cited

U.S. PATENT DOCUMENTS

| | | | |
|---|---|---|---|
| 3,937,172 | 2/1976 | Castoldi | 440/41 |
| 4,004,541 | 1/1977 | Onal | 440/41 |
| 4,252,075 | 2/1981 | Kobayashi | 440/42 |
| 4,315,749 | 2/1982 | Baker et al. | 440/42 |
| 4,538,997 | 9/1985 | Haglund | 440/41 |
| 4,992,065 | 2/1991 | Törneman et al. | 440/41 |
| 5,049,096 | 9/1991 | Henn | 440/4 |
| 5,154,650 | 10/1992 | Nakase | 440/41 |
| 5,304,078 | 4/1994 | Kaneko | 440/41 |
| 5,312,275 | 5/1994 | Place | 440/41 |
| 5,344,344 | 9/1994 | Forsstrom | 440/43 |
| 5,474,007 | 12/1995 | Kobayashi | 440/42 |
| 5,551,898 | 9/1996 | Matsumoto | 440/41 |

OTHER PUBLICATIONS

Kodial 110 Waterjet Propulsion Unit, Kodiak, pp. 15, 18, 26, 27, admitted prior art.

High Thrust Marine Jet Propulsion Unit, Model 1031, Hamilton Jet Brochure, BAS 5M Jun. 1985.

Hamilton Jet 770 Series Jet Units, Hamilton Jet Brochure, BP10m Sep. 1979.

*Primary Examiner*—Stephen Avila

*Attorney, Agent, or Firm*—Andrus, Sceales, Starke & Sawall

[57] ABSTRACT

A reverse mechanism for a jet propelled watercraft includes a reverse gate that provides low restriction to the flow of water through the jet pump, and also provides significant steering characteristics. The reverse gate has a deflector surface with a vertical jet divide that divides the deflector surface. Both sides of the deflector surface are in the form of a simple curve. In the preferred embodiment, the simply-curved deflector surfaces slant inward towards a central apex which serves as the vertical jet divide. The deflector surface spans between a starboard side support structure and a port side support structure which are pivotally mounted along a horizontal axis so that the reverse gate can be moved between a full-up position and a full-down position rearward of the jet pump. Both the starboard side support structure and the port side support structure include apertures therethrough which allow a portion of the jet flow to exit laterally from the reverse gate. When the reverse gate is in the fully down position, a portion of the jet flow is redirected forward to provide reverse thrust, and a portion of the jet of water is deflected laterally to port and laterally to starboard proportionally in accordance with the direction of the jet pump rudder.

18 Claims, 5 Drawing Sheets

REVERSE GATE FOR PERSONAL WATERCRAFT

FIELD OF THE INVENTION

The invention relates to a reverse mechanism for jet propelled watercraft, and in particular, a reverse gate that provides low restriction to the flow of water through the jet pump. In addition, the configuration of the reverse gate provides significant steering characteristics.

BACKGROUND OF THE INVENTION

Jet drives for personal watercraft typically have an engine driven jet pump located within a duct opening through the hull of the watercraft. The jet pump generally consists of an impeller and a stator located within the duct followed by a nozzle. A generally tubular rudder is rotatably attached to the nozzle to direct sea water flowing from the nozzle and steer the watercraft. For instance, the rudder is rotated to direct jet propelled sea water to port to steer the watercraft towards port. Likewise, the rudder is rotated to direct the jet propelled sea water towards starboard to steer the watercraft starboard.

Most reverse gates on commercially available personal watercraft are rotatably mounted to the rudder. With this configuration, the reverse gate moves in conjunction with the rudder when a driver steers the personal watercraft. The purpose of the reverse gate is to redirect water exiting the rudder underneath the boat to provide reverse thrust. Many reverse gates are cupped and/or tightly constructed to ensure that thrust is redirected in the forward direction when the reverse gate is dropped. This type of reverse mechanism has some disadvantages. First, while a cupped reverse gate provides a high velocity reverse thrust flow, it tends to restrict the flow of water through the jet pump. The restriction causes back pressure on the pump, thus allowing the impeller to stall at relatively low RPM. Through testing carried out during the development of the present invention, it has been found that better reverse performance can be achieved by reducing the restriction to flow through the pump and allowing larger mass flows through the pump. A second disadvantage relates to the fact that cupped reverse gates tend to introduce foamy water to the pump inlet, thus unloading the impeller. A third disadvantage relates to reverse/neutral steering characteristics. Since a cupped reverse gate mounted to move with the rudder attempts to redirect the thrust from the rudder essentially 180°, watercraft steering characteristics with the reverse gate down are unpredictable and are not consistent with the steering characteristics of the watercraft when the reverse gate up. For instance, a driver will turn the steering assembly handlebar to starboard to turn the watercraft toward starboard when accelerating in the forward direction, but must turn the handlebar to port to turn the watercraft starboard when moving in the reverse direction. Moreover, steering when the reverse gate is in a neutral position (i.e. partially closed) is almost impossible in these systems.

Some jet pump manufacturers attach the reverse gate so that it does not move with the rudder, thus eliminating the opposite direction steering effect. Nonetheless, these systems still use a cupped reverse gate so that jet flow through pump thrust is at least somewhat restricted and directed substantially forward even when the rudder is steered to the port or starboard.

The reverse mechanism on many commercially available personal watercraft have substantial cable loads, especially at high speeds. These systems require reverse gate position locking devices. Some of these reverse mechanisms also tend to be self-actuating in case the cable or locking device breaks or otherwise malfunctions.

BRIEF SUMMARY OF THE INVENTION

The invention involves the use of a reverse gate that is not cupped, so that the reverse gate deflects a substantial portion of the jet flow from the rudder laterally without creating substantial restriction to the flow through the pump. The reverse gate closes rearward of the rudder exit and allows the rudder to turn inside of the reverse gate to change the direction of the jet flow. In addition, the reverse gate includes a vertical jet divide preferably located along the centerline of the deflector plate of the reverse gate. When the reverse gate is down, a portion of the deflected jet thrusts laterally to the port side and laterally to the starboard side proportionally in accordance with the orientation of the rudder.

The invention not only facilitates high mass flow through the jet pump, but also provides dual lateral steering vectors when the reverse gate is fully down in a reverse position, or even when the reverse gate is partially down in a neutral position. When the reverse gate is fully or partially down, the dual lateral steering vectors provide lateral steering thrust that is in the same general direction as when the reverse gate is fully up. Therefore, the steering characteristics of the watercraft in reverse or neutral are in the same general direction and similar to the steering characteristics of the watercraft in forward. These steering features are particularly useful when using the reverse gate as a forward speed brake for the watercraft and when maneuvering the watercraft under tight conditions, such as during docking procedures.

A reverse mechanism in accordance with the preferred embodiment of the invention includes a nozzle mounted to the watercraft in a fixed position and a rudder rotatably mounted to the nozzle about a vertical steering axis to direct the jet of water from the nozzle and steer the watercraft. A reverse gate is rotatably mounted about a horizontal reverse gate pivot axis, preferably to flanges extending from the nozzle. The reverse gate includes a port side support structure rotatably mounted on a port side nozzle flange at the horizontal reverse gate pivot axis and a starboard side support structure rotatably mounted on the starboard side nozzle flange at the horizontal reverse gate pivot axis. In the preferred embodiment, the port side support structure and the starboard side support structure each have a steering aperture therethrough. A deflector plate spans between a peripheral edge of the port side support structure and a peripheral edge of the starboard side support structure. The deflector plate has a deflector surface and a vertical jet divide equally spaced between the port side edge and the starboard side edge of the deflector surface.

The reverse gate can be rotated about the horizontal reverse gate pivot axis to position the reverse gate rearward of the rudder and create reverse thrust. When the reverse gate is placed rearward of the rudder, a portion of the jet of water flowing through the nozzle and the rudder towards the reverse gate deflector plate is deflected forward of the rudder underneath the rudder, and another portion is deflected laterally through the port side steering aperture and the starboard side steering aperture proportionally in accordance with the orientation of the rudder.

The deflector plate is preferably defined by a port side deflector surface and a starboard side deflector surface, both in the form of a simple-curve which are slanted inward towards the horizontal reverse gate pivot axis to meet along a central vertical apex along the deflector plate, thus forming the vertical jet divide. As used herein, the term "simply-curved" is used to describe the shape of the deflector surfaces in which a surface is substantially curved in only one direction. A simply-curved deflector surface is not a cupped deflector surface. It is preferred that the simply-curved port side deflector surface and the simply-curved starboard side deflector surface slant inward at an angle of about 7% with respect to the horizontal pivot axis. The slanted, simply-curved port side deflector surface and starboard side deflector surface facilitate lateral deflection of the jet to reduce flow restriction and enhance lateral steering thrust.

The preferred reverse gate has a simple geometry which not only provides extraordinary performance characteristics, but also allows the use of simple manufacturing molds thereby providing lower fabrication costs. In particular, the preferred reverse gate, as is shown in the drawings, can be fabricated using aluminum die-cast techniques with a simple open and closed die without any slides or additional tool parts.

Inasmuch as it is contemplated that the reverse gate may be actuated when the watercraft pump is operating at high speeds, it is preferred that the reverse gate be designed to minimize cable loads, especially at high speeds. This is accomplished primarily by providing that the deflector surface have a substantially constant curvature radius that is substantially the same as (or slightly larger than) the distance from the horizontal reverse gate pivot axis to the deflector surface. Cable loads are substantially reduced by maintaining the curvature radius of the deflector surface substantially in correspondence with the horizontal reverse gate pivot axis. However, it is advantageous that the curvature radius be at least slightly larger than the distance of the deflector surface to the horizontal reverse gate pivot axis for at least a portion of the deflector plate so that the reverse gate does not self-actuate in case the reverse cable mechanism fails. Thus, it is preferred that the curvature radius at an the port side edge and the starboard side edge of the deflector surface be approximately equal to the distance of the edges from the horizontal pivot axis, that the curvature remain constant over the entire deflector surface, and that the deflector surface becomes gradually closer to the horizontal pivot axis as the deflector surface extends from each edge to the vertical jet divide. Since the curvature of the deflector surface is preferably constant along the entire surface, the curvature radius at the vertical jet divide will be slightly larger than the distance of the vertical jet divide from the horizontal pivot axis. With this configuration, cable loads for the reverse gate are well below the maximum load levels permitted on standard throttle/shift control cables used in the industry. In addition, sophisticated cable position locking devices using cams or latches are not required. Further, the reverse gate will not self-actuate in case a cable breaks or otherwise malfunctions.

Due to the characteristics of the reverse gate, it may be desirable to use the reverse gate as a watercraft emergency brake when the watercraft is moving in the forward direction. To use the reverse gate as an emergency brake, the reverse gate can be put into a down (or partially down) position when the watercraft is moving forward to provide reverse thrust for braking, and the driver can turn the rudder inside of the reverse gate to provide lateral thrust for steering. One problem with using conventional reverse systems as emergency brakes is that the conventional cupped reverse gates provide too much reverse thrust underneath the watercraft immediately when the cupped reverse gate is dropped. This drives the bow of the watercraft down into the water and can create an instability. Using the invention, however, immediate reverse thrust is tempered because substantial pressure escapes laterally. Therefore, a reverse gate in accordance with the invention can be used as an emergency brake without initiating a severe bow down attitude to the watercraft unless too much throttle is applied. Thus, a driver can drop the reverse gate to slow down the watercraft, easily maintain control, and continue to steer the watercraft while decelerating in a manner consistent with the reverse gate up.

A reverse gate in accordance with the invention can also be used to steer the watercraft with the reverse gate located in a neutral position. To do this, the reverse gate is positioned geometrically between 70% to 85% towards the full-down reverse position. A first portion of the jet exiting the rudder continues to flow rearward without interference from the deflector plate to provide forward thrust. A second portion of the jet is deflected forward of the reverse gate to provide reverse thrust to counteract the forward thrust. A third portion of the jet is deflected laterally to the port side and the starboard side proportionally in accordance with the direction of the rudder. Thus, the watercraft can be steered effectively even when the watercraft is not moving in the forward or rearward direction.

It should therefore be appreciated that a reverse gate in accordance with the invention has several features and advantages. The principal objects of the invention are listed below.

One object of the invention is to provide a reverse gate that does not substantially restrict the flow of water through a jet pump in a jet propulsion system for a personal watercraft.

Another object of the invention is to provide a reverse gate in which the steering characteristics for the watercraft with the reverse gate down or partially down (e.g., reverse, neutral, emergency braking, etc.) are generally in the same direction and similar to the steering characteristics of the watercraft with the reverse gate up (e.g., forward).

Another object of the invention is to provide a reverse gate that has relatively small cable loads for actuating the reverse gate. Therefore, the reverse mechanism does not require position locking devices.

Another object of the invention is to provide a reverse gate that does not self-actuate in case an actuation cable breaks or otherwise malfunctions.

Another object of the invention is to provide a reverse gate that is suitable for use as an emergency brake when the watercraft is traveling in a forward direction.

Another object of the invention is to provide a reverse gate that is suitable to provide for steering the watercraft when the reverse gate is in a neutral position, thereby enhancing the maneuverability of the watercraft under tight conditions.

Another object of the invention is to provide a reverse gate geometry that allows the reverse gate to be fabricated in a practical, cost-effective manner.

Another object of the invention is to provide a compact reverse mechanism that is able to carry out the above objectives.

Other objects and advantages of the invention may be apparent to those skilled in the art upon reviewing the following drawings and description thereof.

DETAILED DESCRIPTION OF THE INVENTION

Figure 1:
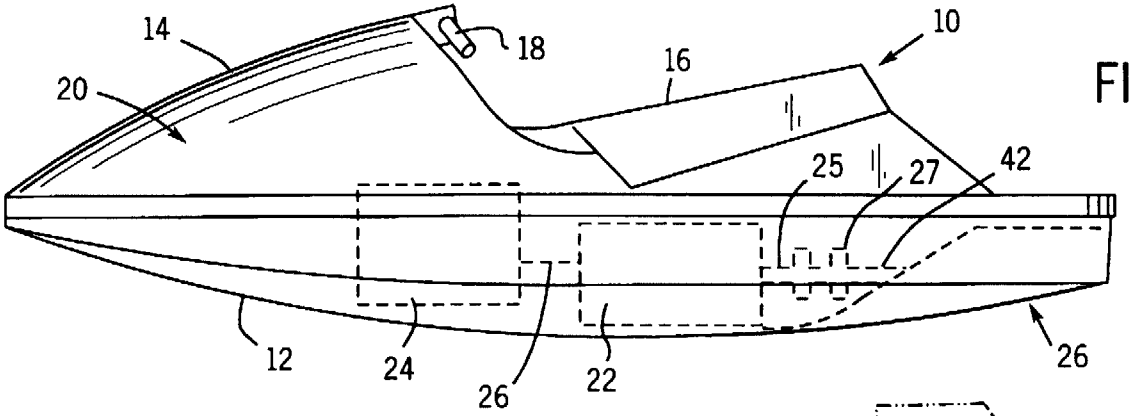
FIG. 1 is a schematic view of a personal watercraft.
Figure 4:
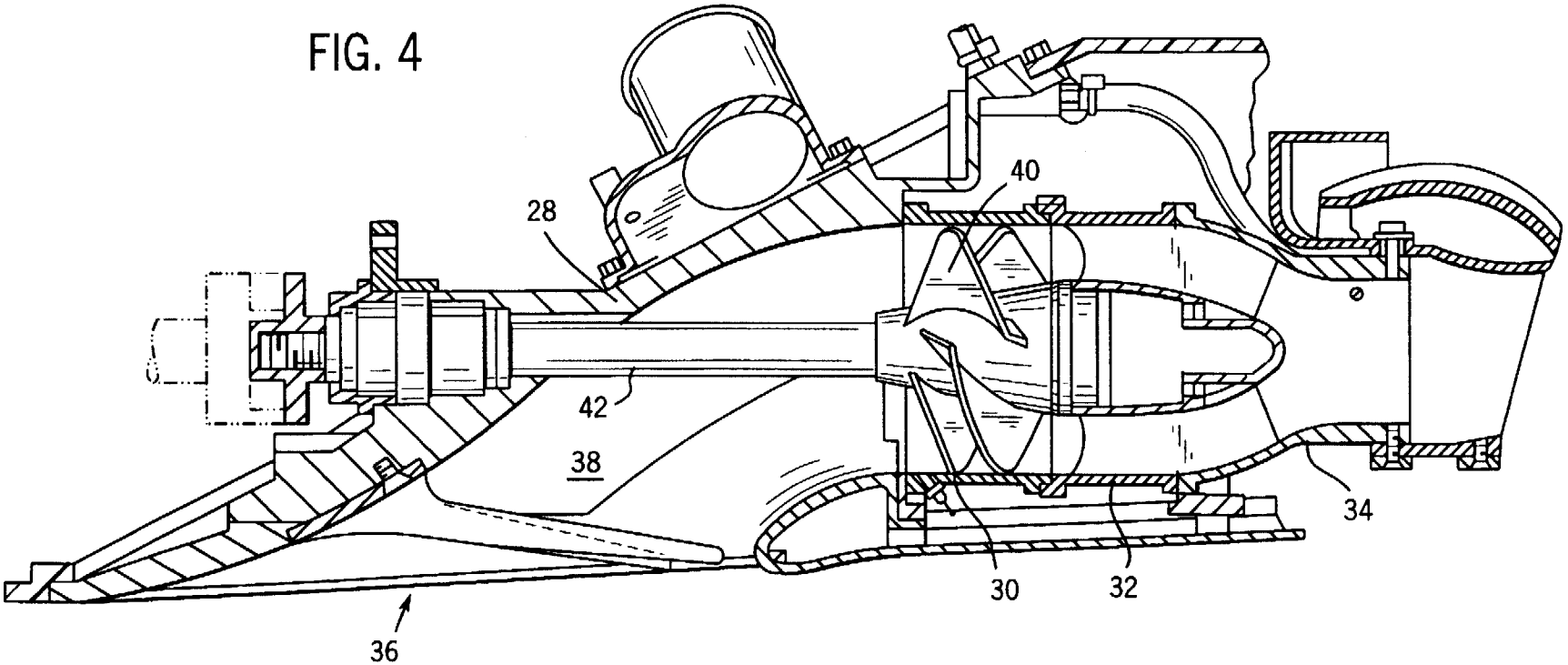
FIG. 4 is a longitudinal sectional view of the jet pump shown in FIG. 2.

FIG. 1 shows a personal watercraft 10. The watercraft has a hull 12, and a deck 14, both preferably made of fiber reinforced plastic. A driver and/or passenger riding on the watercraft 10 straddles the seat 16. The driver steers the watercraft 10 using a steering assembly 18 located forward of the seat 16. An engine compartment 20 is located between the hull 12 and the deck 14. A gasoline fueled internal combustion engine 22 is located within the engine compartment 20. A fuel tank 24 is located forward of the engine 22. The engine 22 receives fuel from the fuel tank 24 through a fuel line 26. The engine 22 has an output shaft 25 that is coupled via coupler 27 to a jet pump located rearward of the engine 22 generally in the vicinity shown by arrow 26. FIGS. 2–7 show a jet pump 26 having a reverse mechanism in accordance with a preferred embodiment of the invention. In general, the jet pump 26 includes an intake housing 28 that is attached to the hull 12, and an impeller 40 within a wear ring 30, a stator 32, and a nozzle 34 all attached to the intake housing 28. The preferred intake housing 28 is described in detail in copending patent application Ser. No. 08/710,868, entitled "Intake Housing for Personal Watercraft", by James R. Jones, and assigned to the assignee of the present application, which is herein incorporated by reference. Referring in particular to FIG. 4, the intake housing 28 has an inlet opening 36 that provides a path for sea water to flow into an intake duct 38 located within the intake housing 28. Sea water flows upward and rearward through the intake duct 38 to the impeller 40. The impeller 40 rotates within the wear ring 30. The wear ring 30 is attached to the intake housing 28 rearward of intake duct 38. The impeller 40 is rotatably driven by an impeller drive shaft 42 which is coupled to the engine output shaft 25 via coupler 27. As the impeller 40 rotates within the wear ring 30, the impeller 40 accelerates sea water flowing through the intake housing 38. The stator 32 is located downstream of the impeller 40, and includes several stationary vanes to remove swirl from the accelerated sea water. When the sea water exits the stator 32, it flows through nozzle 34. The preferred stator and nozzle configuration is described in detail in copending patent application Ser. No. 08/710,869, entitled "Stator and Nozzle Assembly for Jet Propelled Personal Watercraft" by James R. Jones, and assigned to the assignee of the present application, which is herein incorporated by reference.

Figure 2:
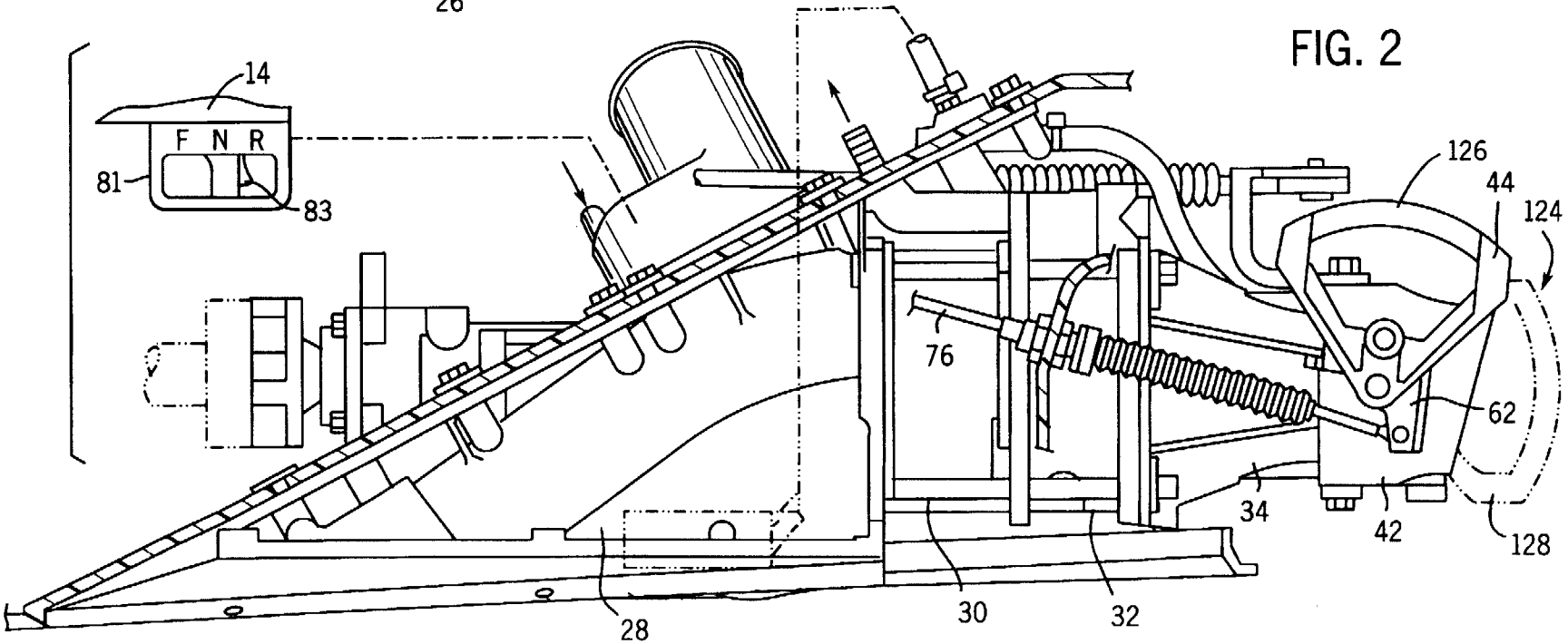
FIG. 2 is a side view of a jet pump using a reverse mechanism in accordance with the invention.
Figure 3:
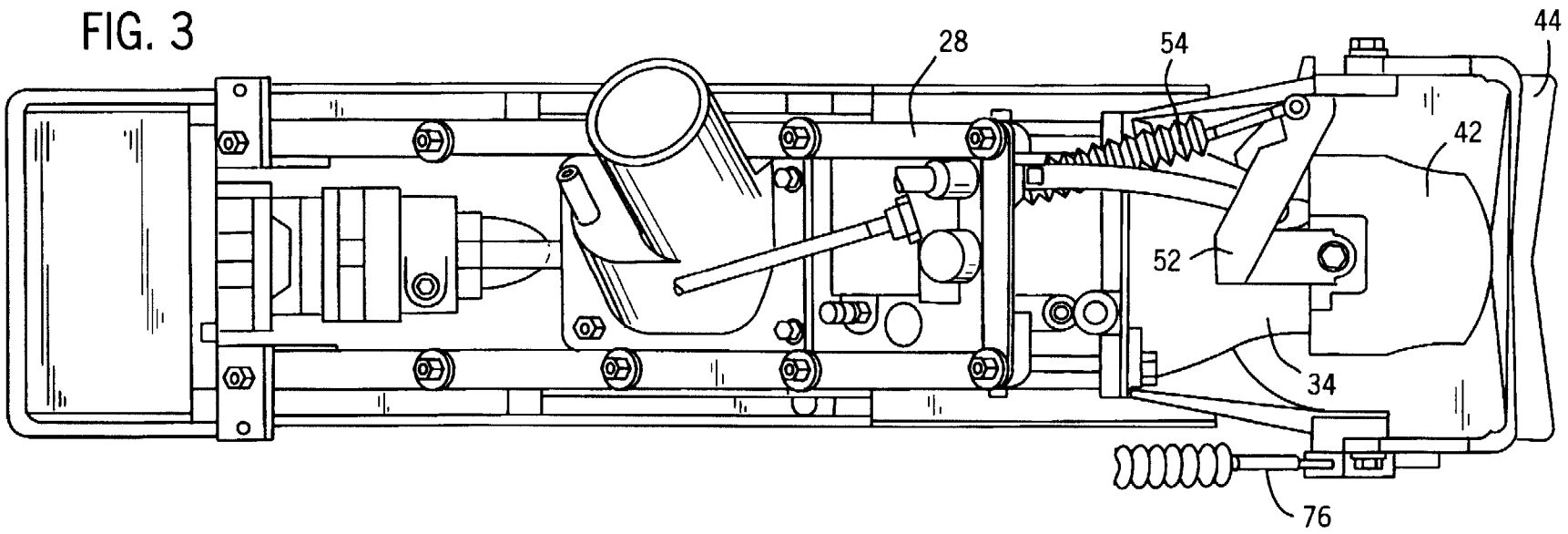
FIG. 3 is a top view of the jet pump and reverse mechanism shown in FIG. 2.

Referring in particular to FIG. 2, a generally tubular rudder 42 is pivotally mounted to the nozzle 34 to rotate about a vertical axis and steer the watercraft 10. A reverse gate 44 is mounted to rotate about a horizontal axis so that the reverse gate 44 can be positioned rearward of the rudder 42 to deflect the jet flow from the pump 26 and provide reverse thrust for the watercraft 10.

Figure 5:
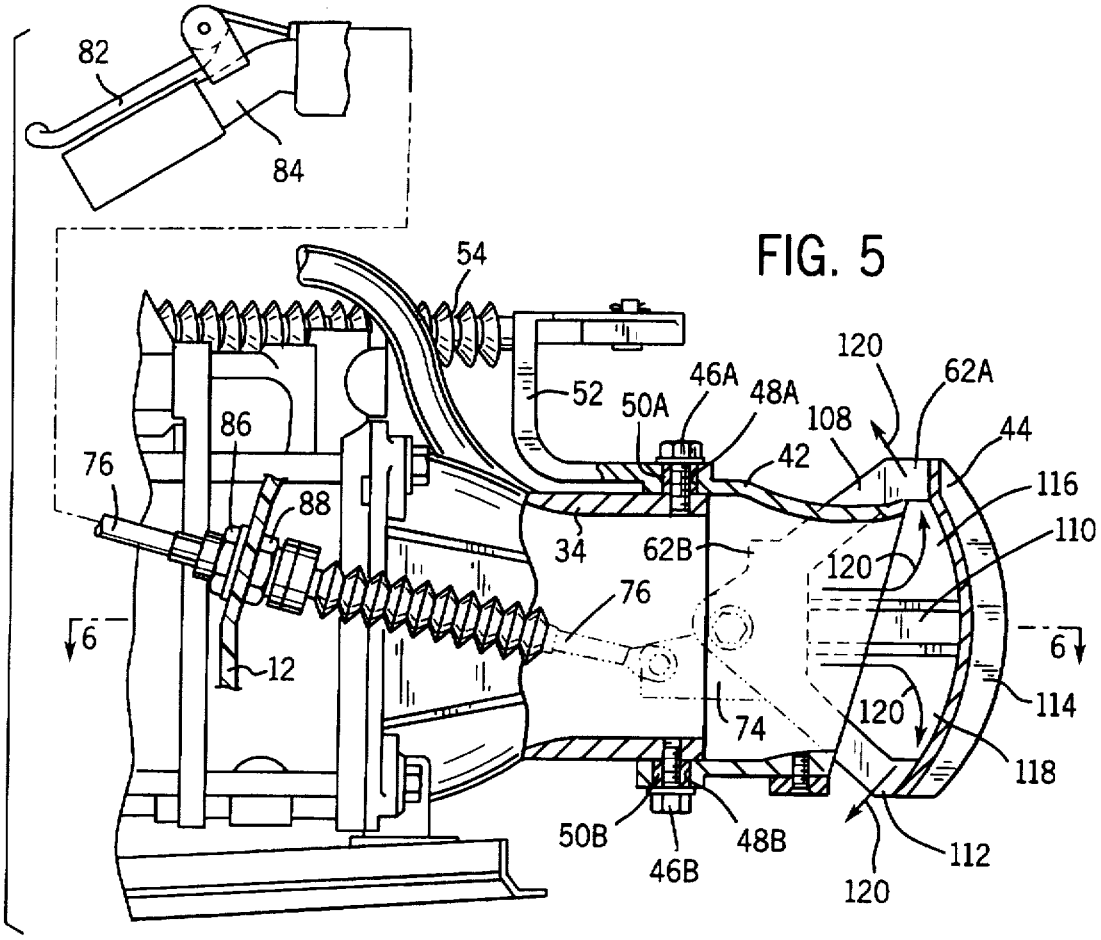
FIG. 5 is a side longitudinal sectional view of a reverse mechanism in accordance with the invention as shown in FIG. 2.
Figure 6:
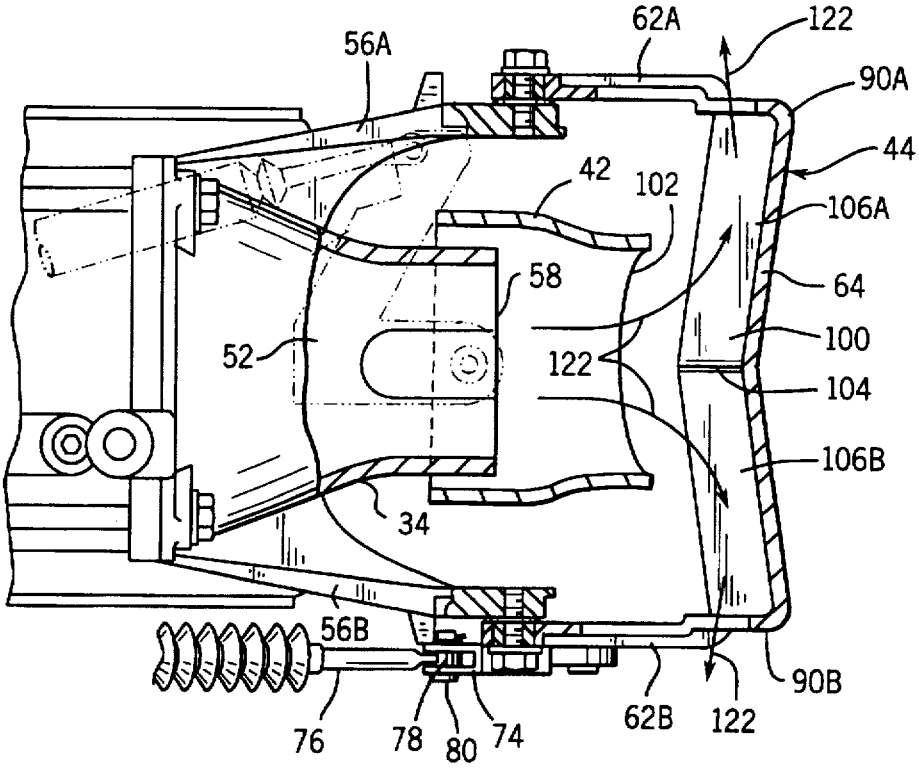
FIG. 6 is a top sectional view of a reverse mechanism in accordance with the invention as shown in FIGS. 2 and 5.
Figure 7:
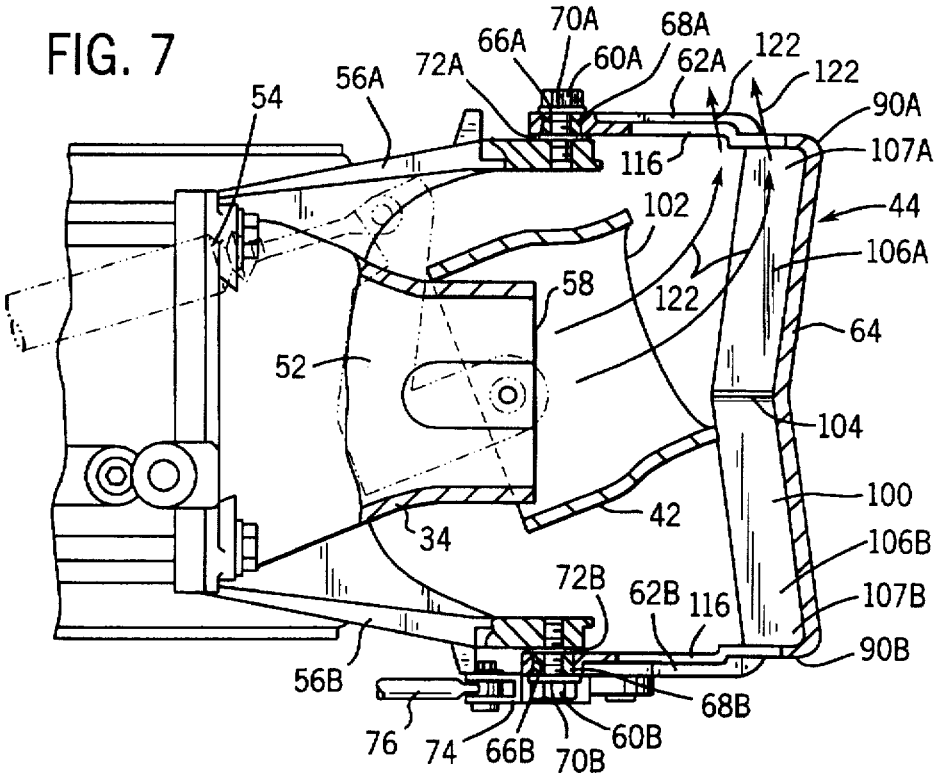
FIG. 7 is a view similar to FIG. 6 in which the rudder is turned towards starboard.

FIGS. 5–7 show the preferred reverse mechanism in greater detail. The tubular steering rudder 42 is pivotally mounted along the centerline of the nozzle 34 using an axle bolt 46A on the top side of the nozzle 34 and the axle bolt 46B on the bottom side of the nozzle 34. The top axle bolt 46A passes through an opening 48A in the rudder 42 and is secured in the nozzle 34. A bushing 50A is provided in the opening 48A in the rudder 42. Likewise, the lower axle bolt 46B passes through an opening 48B in the rudder 42 and is secured in the nozzle 34. A bushing 50B is provided in the opening 48B in the rudder 42. The bushings 50A and 50B are provided so that the rudder 42 can easily rotate about the axle bolts 46A and 46B to steer the watercraft 10. The rudder 42 includes a steering actuating arm 52 that is pushed or pulled by steering actuating cable 54 to rotate the tubular rudder 42 and steer the watercraft 10 (compare FIGS. 6 and 7).

The nozzle structure 34 includes a pair of mounting flanges 56A and 56B extending generally rearward outside of the main nozzle portion. Reverse gate mounting flanges 56A and 56B extend rearward of the nozzle outlet 58. Mounting bolts 60A and 60B, FIGS. 6 and 7, are used to pivotally mount the reverse gate 44 to the reverse gate mounting flanges 56A and 56B about the horizontal reverse gate pivot axis. The reverse gate 44 generally includes a starboard side support structure 62A, a port side support structure 62B, and a deflector plate 64 spanning therebetween. Reverse gate mounting bolt 60A passes through an opening 66A through the fore end of the starboard side support section 62A and is secured in the aft end of the mounting flange 56A of the nozzle 34. A bushing 68A is provided in opening 66A in the starboard side support structure 62A. The bushing 66A, as well as washers 70A and 72A enhance the ability of the reverse gate 44 to pivot around mounting bolt 60A. Likewise, reverse gate mounting bolt 60B passes through an opening 66B in the fore end of the port side support structure and is secured in the aft end of the port side mounting flange 56B on the nozzle 34. A bushing 68B is provided in opening 66B in the port side support structure 62B. The bushing 68B as well as washers 70B and 72B facilitate the ability of the reverse gate 44 to rotate about mounting bolt 60B. The reverse gate mounting bolts 60A and 60B are in axial alignment along the horizontal reverse gate pivot axis. It is preferred that the horizontal reverse gate pivot axis be located rearward of the nozzle outlet 58.

FIG. 2 illustrates a reverse gate actuator 81 that is mounted on the deck 14 of the watercraft 10. The reverse gate actuator 81 includes a trigger mechanism 83 that can be squeezed by the driver of the watercraft 10 to reposition the reverse gate actuator 81 between Forward, Neutral, and Reverse positions. The reverse gate actuator 81 is mechanically connected to the reverse gate actuating cable 76. FIG. 5 illustrates a reverse gate actuator including a hand lever 82 mounted on a steering assembly handlebar 84 for the watercraft 10. The hand lever 82 is electronically or mechanically connected to the reverse gate actuating cable 76. Note that the reverse gate actuating cable 76 is rigidly secured to the hull 12 using fittings 86 and 88 as the cable 76 passes through the hull 12. Thus, the line of motion of the reverse gate actuating cable 76 from the fitting 88 attached to the hull 12 to the actuating member 74 on the reverse gate 44 is skewed from the reverse gate pivot axis, and is only slightly curvilinear along its relatively short stroke.

A reverse gate actuating member 74 extends from the port side support structure 62B of the reverse gate 44. A reverse gate actuation cable 76 is pivotally attached to the reverse gate actuating member 74. In particular, the reverse gate actuating cable 76 has an eyelet 78 which is secured to the actuating member 74 by a pivot pin 80. The pivot pin 80 is secured in place on the reverse gate actuating member 74 by a cotter pin. The reverse gate 44 is positioned in the full-down position, FIG. 5, by pulling on reverse gate actuating cable 76 and rotating the reverse gate 44 clockwise. The reverse gate 44 is positioned in the full-up position by pushing the reverse gate actuating cable 76 and rotating the reverse gate 44 counter-clockwise.

The reverse gate deflector plate 64 spans between an outer edge 90A of the starboard side support structure 62A and an outer edge 90B of the port side support structure 62B. The deflector plate 64 has a deflector surface 100 that faces the rudder outlet 102. The deflector surface 100 has a vertical jet divide 104 that is spaced equally between the outer edge 90A of the starboard side support structure 62A and the outer edge 90B of the port side support structure 62B. It is preferred that the vertical jet divide 104 extend vertically along the entire deflector surface 100 on the deflector plate 64. The vertical jet divide 104 separates the deflector surface 64 into a starboard side deflector surface 106A and a port side deflector surface 106B. Both the starboard side deflector surface 106A and the port side deflector surface 106B are formed in the shape of a simple curve. That is, each deflector surface 106A and 106B has constant curvature in one direction, for example in the form of a section taken from a cylinder having a constant circular diameter. The deflector surfaces 106A and 106B are not cupped. In the embodiment of the invention shown in FIGS. 5–7, the simply-curved deflector surfaces 106A, 106B are slanted symmetrically inward, preferably at about 7° with respect to the horizontal reverse gate pivot axis. The deflector surfaces 106A and 106B meet along a central vertical apex 104 along the deflector surface 100. The central vertical apex 104 serves as the vertical jet divide 104.

The structure of the starboard side support structure 62A and the port side support structure 62B for the reverse gate are illustrated best in FIG. 5. The starboard side support structure 62A and the port side support structure 62B are preferably mirror images of one another, except for the actuating member 74 which extends from the port side support structure 62B but does not extend from the starboard side support structure 62A. In FIG. 5, starboard side support structure 62A is illustrated in solid lines, whereas the port side support structure 62B is illustrated in phantom. Both the starboard side support structure 62A and the port side support structure 62B include an upper radial support wall 108, a middle radial support wall 110, and a lower radial support wall 112. A lateral thrust control wall 114 extends away from the outer edge of the deflector surfaces 106 towards the horizontal reverse gate pivot axis. Each side support structure 62A, 62B therefore provides first and second steering apertures 116, 118.

When the reverse gate 44 is positioned in the full-down position so that the deflector surface 100 of the reverse gate 44 is directly rearward of the rudder outlet 102, a portion of the jet of water is deflected forward of the rudder 42 as illustrated by arrows 120 in FIG. 5, and another portion of the jet of water is deflected laterally through the starboard side support structure 62A and laterally through the port side support structure 62B proportionally in accordance with the direction of the rudder 42 as illustrated by arrows 122 in FIGS. 6 and 7. Thus, instead of cupping and restricting lateral thrust vectors 122, the reverse gate 44 allows lateral thrust vectors to escape laterally, and allow the driver to steer the watercraft 10 in a similar manner when the reverse gate is down or partially down as when the reverse gate 44 is in the full-up position.

It is preferred that the port side and starboard side lateral thrust control walls 114 be sized so that the amount of reverse thrust (arrows 120) is essentially equal to about ½ of the total combined amount of lateral thrust in the port direction and in the starboard direction (arrows 122) when the reverse gate 44 is in the full-down position and the rudder 42 is directed straight rearward, FIG. 6. In the preferred embodiment of the invention, the radial length of the side support structure 62A and 62B is preferably about 4 inches, and the width of the lateral thrust control walls 114 is preferably about 0.4 inches. It has been found that sizing the lateral thrust control walls 114 in this manner provides desirable steering characteristics when the reverse gate 44 is in the fully down position and also prevents the stem of the watercraft 10 from lifting severely when the reverse gate 44 is dropped when the watercraft is moving in the forward direction.

To minimize cable loads on reverse gate actuating cable 76, it is desirable that the curvature radius of the deflector surface 100 be in substantial correspondence with the horizontal reverse gate pivot axis through mounting bolts 60A, 60B. However, it is also desirable that the reverse gate 44 does not self-actuate in case the reverse cable mechanism fails. Therefore, it is preferred that the average curvature radius of the deflector surface 100 be at least slightly larger than the distance between the horizontal reverse gate pivot axis and the deflector surface 100. In the embodiment of the invention shown in FIGS. 5–7, this is accomplished by providing each side 106A, 106B of the deflector surface 100 with a constant curvature radius that is approximately equal to the distance from the outer edges 107A, 107B of the sides 106A, 106B to the horizontal reverse gate pivot axis. Although the curvature for the deflector surface 100 remains constant over the entire deflector surface 100, the deflector surface 100 moves gradually closer to the horizontal reverse gate pivot axis as the deflector surface 100 extends from each edge 107A, 107B towards the vertical jet divide 104. Therefore, the curvature radius for the deflector surface 100 will be slightly larger than the average distance of the deflector surface 100 from the horizontal reverse gate pivot axis. Note that for packaging reasons it is desirable to locate the deflector surface 100 for the reverse gate 44 as close to the rudder outlet 102 as is possible without restricting the movement of the rudder 42, or restricting flow from the rudder outlet 102. Cable loads for the reverse gate 44 shown in FIGS. 5–7 are well below maximum load levels permitted on standard throttle/shift control cables used in the marine industry, yet the reverse gate 44 will not self-actuate in case a cable breaks or otherwise malfunctions.

The reverse gate 44 shown in FIGS. 5–7 provides a simple structural design that can be fabricated in a practical and cost-effective manner. The reverse gate 44 is preferably made by die casting aluminum, but can also be made by injection molding high strength plastic. The reverse gate 44 can be manufactured cost-effectively because its simple geometry can be molded using an open and closed die without any additional slides or additional tool parts. When fabricating the reverse gate 44, a die half can come off the front, and a die half can come off the back, leaving only very little machining. Only pivot holes 66A, 66B, the actuating cable mounting structure on the actuating member 74, and anode mount holes need to be machined. The steering apertures 116, 118 and the side support structure 62A, 62B can be formed by properly designing the mold halves so that the mold halves match and slide together to shut off the area of the steering apertures 116, 118 so that aluminum will not flow into the apertures 116, 118 during the fabrication process.

Referring to FIG. 2, reference numeral 124 shows the reverse gate 44 being located between a full-up position 126, and a full-down position 128. This position 124 for the reverse gate 44 is a neutral position, in which forward thrust directly from the rudder 42 passing underneath the reverse gate 44 is substantially equal to reverse thrust flowing underneath the watercraft 10 after being deflected from the reverse gate 44. With the preferred reverse mechanism, the neutral position lies geometrically 70%–85% towards the full-down reverse position. Depending upon the specific structure of the reverse gate 44, the neutral position 124 may lie outside of the 70%–85% range identified above. A reverse gate 44 in accordance with the invention provides lateral steering vectors as shown by arrows 122 in FIGS. 6 and 7, even when the reverse gate 44 is located in a neutral position as is shown by arrow 124 in FIG. 2. This can be particularly advantageous when maneuvering the watercraft 10 under tight circumstances, and is especially useful during docking procedures.

The reverse gate 44 shown in FIGS. 5–7 provides little restriction to the flow going through the jet pump 26 when the reverse gate 44 is fully down in the reverse position 128 or partially down in the neutral position 124, FIG. 2. The reverse gate 44 therefore can be used at high engine speeds without causing the pump 26 to stall. In addition, the configuration of the reverse gate 44 allows the reverse gate 44 to be located closer to the rudder outlet 102 than conventional cupped reverse buckets without stalling the pump 26 because additional pressure is relieved laterally.

Figure 8:
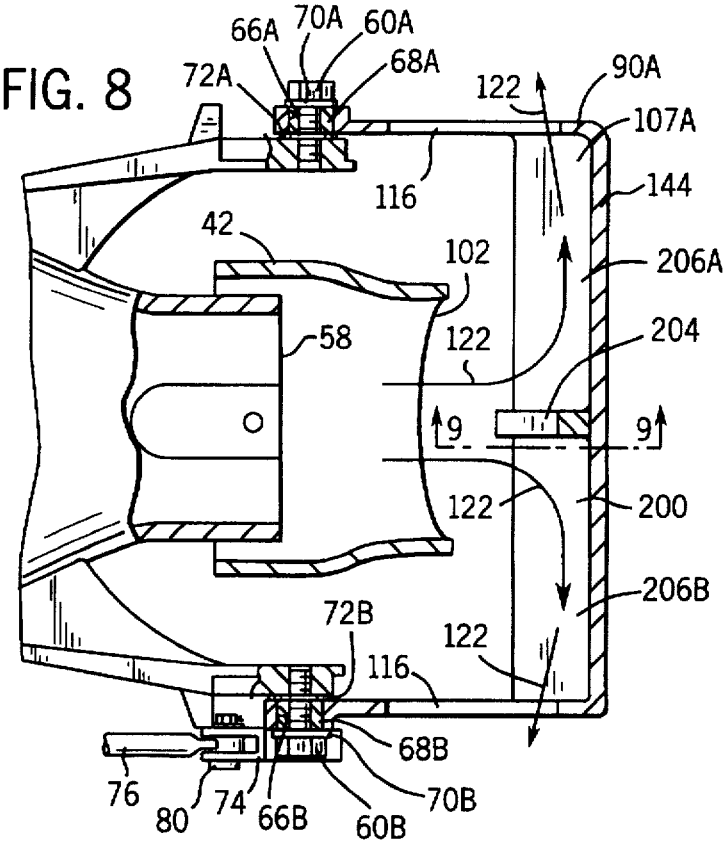
FIG. 8 is a top sectional view of another embodiment of a reverse gate in accordance with the invention.
Figure 9:
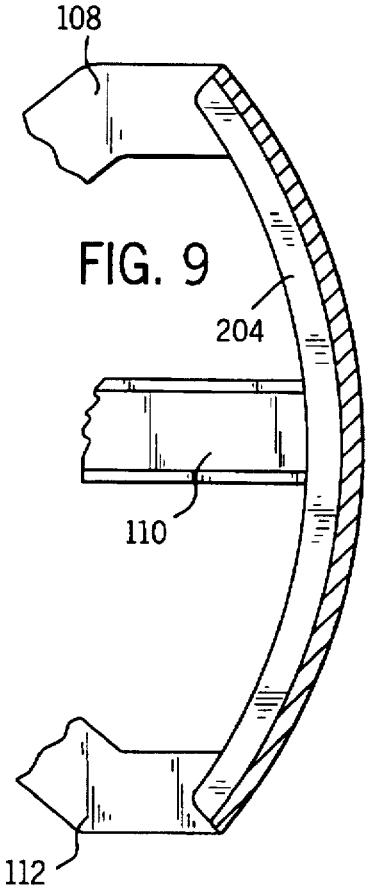
FIG. 9 is a sectional view taken along lines 9—9 in FIG. 8.

FIGS. 8 and 9 show a reverse gate 144 in accordance with the second embodiment of the invention. In many respects, the reverse gate 144 is similar to reverse gate 44 shown in FIGS. 5–7 and like reference numerals are used where appropriate to facilitate understanding.

In the embodiment of the reverse gate 144 shown in FIGS. 8 and 9, the vertical jet divide 204 is a wall extending perpendicularly from the vertical centerline of the deflector surface 200. The perpendicular vertical jet divide wall 204 need only extend ¼ to ½ of an inch from the deflector surface 200 in order for the wall 204 to function as a vertical jet divide. In this embodiment, it is still desirable that the starboard side deflector surface 206A and the port side deflector surface 206B be in the form of simple curves. Further, in order to reduce loads on reverse gate actuator cable 76, it is desirable that the radius of curvature of the deflector surface 200 be only slightly greater than the distance between the horizontal reverse gate pivot axis through mounting bolts 60A and 60B and the deflector surface 200. However, in this embodiment, it is not necessary that the starboard side deflector surface 206A and the port side deflector surface 206B be slanted as in the embodiment shown in FIGS. 5–7. Although the performance of the reverse gate 144 shown in FIGS. 8 and 9 is not identical to the performance reverse gate 44 shown in FIGS. 5–7, the reverse gate 144 shown in FIGS. 8–9 provides many if not all of the advantages of the reverse gate 44 shown in FIGS. 5–7.

Other configurations, modifications, alternatives and equivalents to the embodiments of the reverse gate shown in the drawings may be apparent to those skilled in the art. Such modifications, alternatives or equivalents should be considered to be within the scope of the following claims.

We claim:

1. In a jet propelled watercraft having a jet pump, a reverse mechanism comprising:

a stationary nozzle mounted to the watercraft in a fixed position, the stationary nozzle outputting a jet of water rearward of the watercraft to propel the watercraft;

a rudder rotatably mounted about a vertical axis to direct the jet of water from the stationary nozzle and steer the watercraft;

a reverse gate rotatably mounted about a horizontal pivot axis and lying in a horizontal plane relative to the stationary nozzle, the horizontal pivot axis being stationary with respect to the stationary nozzle, the reverse gate including:

a port side support structure rotatably mounted to rotate about the horizontal pivot axis;

a starboard side support structure mounted to rotate about the horizontal pivot axis;

a deflector plate that extends at least in part between the port side support structure and the starboard side support structure, the deflector plate having a deflector surface including a vertical jet that is located closer to the horizontal pivot axis than the remaining portions of the deflector surface, the vertical jet divide being equally spaced between the port side support structure and the starboard side support structure to separate the deflector surface into a port side deflector surface and a starboard side deflector surface, the port side deflector surface and the starboard deflector surface being mirror images of each other, and each being symmetrical with respect to the horizontal plane passing through the horizontal pivot axis when the reverse mechanism is actuated to position the reverse gate rearward of the rudder in a full-down position;

wherein a portion of the jet of water is redirected forward of the rudder and a portion of the jet of water is deflected laterally to port and laterally to starboard proportionally in accordance with the direction of the rudder when the reverse mechanism is actuated to position the reverse gate rearward of the rudder in a full-down position; and further wherein at least some of the laterally deflected portion of the jet of water is deflected in a direction substantially perpendicular to the direction of the jet of water as the jet of water exits the stationary nozzle.

2. A reverse mechanism as recited in claim 1 wherein the port side support structure and the starboard side support structure each have a steering aperture therethrough and the laterally deflected portion of the jet flows through the steering apertures proportionally in accordance with the orientation of the rudder.

3. A reverse mechanism as recited in claim 1 wherein an outer intersecting edge of the deflector surface adjacent the port side support structure and an outer intersecting edge of the deflector surface adjacent the starboard side support structure each have a curvature radius approximately equal to the distance of the intersecting edges from the horizontal pivot axis; and the deflector surface gradually approaches closer to the horizontal pivot axis as the deflector surface extends from each intersecting edge towards the vertical jet divide.

4. A reverse mechanism as recited in claim 1 wherein the deflector plate has a deflector surface having a curvature radius approximately equal to the distance of the deflector surface to the horizontal pivot axis; and the deflector plate further comprises a vertical jet divide wall that extends inward towards the horizontal pivot axis to split the deflector surface into a port side deflector and a starboard side deflector surface.

5. A reverse mechanism as recited in claim 1 wherein the stationary nozzle includes a port side mounting flange and a starboard side mounting flange, the port side support structure of the reverse gate is rotatably mounted to the port side mounting flange and the starboard side support structure of the reverse gate is rotatably mounted to the starboard side mounting flange, and the stationary nozzle has an outlet located so that the horizontal pivot axis passes rearward of the stationary nozzle outlet.

6. A reverse mechanism as recited in claim 1 further comprising a shifting mechanism that actuates the reverse gate and provides a forward position for the jet pump in which the reverse gate is in a full-up position, a reverse position for the jet pump in which the reverse gate is in a full-down position, and a neutral position for the jet pump in which the reverse gate is positioned between the full-up position and the full-down position so that thrust in the forward direction is substantially equal to thrust in the reverse direction.

7. A reverse mechanism as recited in claim 1 wherein the reverse mechanism is configured so that the amount of reverse thrust is essentially equal to about one-half of the total combined amount of lateral thrust in the port direction and in the starboard direction when the reverse gate is in the fully down position and the rudder is directed straight rearward.

8. In a jet propelled watercraft having a jet pump, a reverse mechanism comprising:

a stationary nozzle mounted to the watercraft in a fixed position, the stationary nozzle outputting a jet of water rearward of the watercraft to propel the watercraft;

a rudder rotatably mounted to the stationary nozzle about a vertical axis to direct the jet of the water from the stationary nozzle and steer the watercraft;

a reverse gate mounted to rotate about a horizontal pivot axis which is stationary with respect to the stationary nozzle, the reverse gate including:

a port side structure mounted to rotate about the horizontal pivot axis;

a starboard side support structure rotatably mounted to rotate about the horizontal pivot axis;

a deflector plate that extends at least in part between the port side support structure and the starboard side support structure, the deflector plate having a deflector surface being defined by a port side deflector surface and a starboard side deflector surface, the port side deflector surface being in the form of a cylinder section having a constant curvature radius and the starboard side deflector surface also being in the form of a cylinder section having a constant curvature radius, both of which are slanted inward and which meet at a central vertical apex along the deflector surface.

9. A reverse mechanism as recited in claim 8 wherein the curvature radius for both the port side deflector surface and the starboard side deflector surface is substantially equal to the distance of the outer edges of the port side deflector surface and the starboard side deflector surface to the horizontal pivot axis.

10. A reverse mechanism as recited in claim 8 wherein the port side support structure and the starboard side support structure each have a steering aperture therethrough, and the reverse mechanism can be actuated to position the reverse gate rearward of the rudder so that a portion of the jet of water is redirected forward of the rudder and a portion of the jet of water is deflected laterally through the port side steering aperture and laterally through the starboard side steering aperture proportionally in accordance with the direction of the rudder, at least some of the laterally deflected portion of the jet of water being deflected perpendicularly to the direction of the jet of water as the jet of water exits the stationary nozzle; and further wherein the amount of reverse thrust when the reverse gate is positioned rearward of the rudder in a full-down position does not substantially change as a function of rudder rotation to steer the watercraft.

11. A reverse mechanism as recited in claim 9 further comprising a shifting mechanism that actuates the reverse gate and provides a forward position for the jet pump in which the reverse gate is in a full-up position, a reverse position for the jet pump in which the reverse gate is in a full-down position, and a neutral position for the jet pump in which the reverse gate is positioned between the full-up position and the full-down position so that thrust in the forward direction is substantially equal to thrust in the reverse direction.

12. A reverse mechanism as recited in claim 9 further comprising:

a reverse gate actuating cable that is secured cable that is reverse gate at a location below the stationary horizontal povot axis so that the reverse mechanism is actuated to position the reverse gate rearward of rudder by pulling the reverse gate cable and causing the reverse gate to rotate downward about the horizontal pivot axis.

13. In a jet propelled watercraft having a jet pump and a reverse mechanism comprising:

a stationary nozzle outputting a jet of water rearward of the watercraft to propel the watercraft;

a rudder mounted to rotate about a vertical axis to direct the jet of water from the nozzle and steer the watercraft;

a reverse gate mounted to rotate about a horizontal pivot axis which is stationary with respect to the stationary nozzle, the reverse gate including:

a port side support structure mounted to rotated about the horizontal pivot axis, a starboard side support structure mounted to rotate about the horizontal pivot axis, and a deflector plate that extends at least in part between the port side support structure and the starboard side support structure, the deflector plate having a deflector surface including a vertical jet divide that is located closer to horizontal pivot axis than the remaining portions of the deflector surface, the vertical jet divide being equally spaced between a port side edge and a starboard side edge of the deflector surface;

a method of braking the watercraft when the watercraft is moving forward, the method comprising the steps of:

pivotally lowering the reverse gate so that the deflector plate is rearward of the rudder;

providing reverse thrust by using the deflector plate to deflect a portion of the jet of water from the rudder in a direction substantially forward of the reverse gate; and providing steering thrust by using the deflector plate to laterally deflect another portion of the jet of water from the rudder substantially in the port direction and in the starboard direction proportionally in accordance with the orientation of the rudder;

wherein at least some of the laterally deflected portion of the jet of water is deflected in a direction substantially perpendicular to the direction in which the jet of water exists the stationary nozzle and the amount of reverse thrust when the reverse gate is lowered does not substantially change as a function of rudder rotation to steer the watercraft.

14. A method of braking a watercraft as recited in claim 13 wherein the amount of reverse thrust provided by deflecting a portion of the jet of water from the rudder in a direction substantially forward of the reverse gate is essentially equal to about one-half of the total combined amount of port side steering thrust provided by laterally deflecting a portion of the jet of water from the rudder to the amount of starboard steering thrust provide by deflecting a portion of the jet of water from the rudder when the reverse gate is in the full-down position and the rudder is directed straight rearward.

15. In a jet propelled watercraft having a jet pump comprising:

a stationary nozzle outputting a jet of water rearward of the watercraft to propel the watercraft;

a rudder mounted to rotate about a vertical axis to direct the jet of water from the stationary nozzle and steer the watercraft; and a reverse gate mounted to rotate about a horizontal pivot axis which is stationary with respect to the stationary nozzle, the reverse gate including a port side support structure mounted to rotate about the horizontal pivot axis, a starboard side support structure mounted to rotate about the horizontal pivot axis, and a deflector plate that extends at least in part between the port side support structure and the starboard side support structure, the deflector plate having a deflector surface including a vertical jet divide that is located closer to the horizontal pivot axis than the remaining portions of the deflector surface, the vertical jet divide being equally spaced between a port side edge and a starboard side edge of the deflector surface;

a method of steering the watercraft when the watercraft is shifted into neutral, the method comprising the steps of:

pivotally lowering the reverse gate so that the deflector plate is positioned between a full-down position and a full-up position;

providing forward thrust by allowing a first portion of the jet of water from the rudder to continue substantially without interference from the deflector plate;

providing reverse thrust to counteract the forward thrust by using the deflector plate to deflect a second portion of the jet of water from the rudder in a direction substantially forward of the reverse gate; and providing lateral steering thrust by using the deflector plate to laterally deflect a third portion of the jet of water from the rudder in the port direction and in the starboard direction proportionally in accordance with the orientation of the rudder, wherein at least some of the laterally deflected third portion is deflected substantially perpendicularly to the direction of the jet of water as the jet of water exits the stationary nozzle.

16. In a jet propelled watercraft having a jet pump, a reverse mechanism comprising:

a stationary nozzle mounted to the watercraft in a fixed position, the nozzle outputting a jet of water rearward of the watercraft to propel the watercraft;

a rudder rotatably mounted about a vertical axis to direct the jet of water from the stationary nozzle and steer the watercraft;

a reverse gate rotatably mounted about a horizontal pivot axis which is stationary with respect to the stationary nozzle, the reverse gate including:

a port side support structure rotatably mounted to rotate about the horizontal pivot axis;

a starboard side support structure mounted to rotate about the horizontal pivot axis;

a deflector plate that extends at least in part between the port side support structure and the starboard side support structure, the deflector plate having a deflector surface including a vertical jet divide that is located closer to the horizontal pivot axis than the remaining portions of the delector surface, the vertical jet divide being equally spaced between the port side support structure and the starboard side support structure to separate the deflector surface into a port side deflector surface and a starboard side deflector surface;

wherein the port side support structure and the starboard side support structure each include an upper radial support wall, a lower radial support wall and middle radial support extending generally from the horizontal pivot axis to the respective side of the deflector plate, and both the port side support structure and the starboard side support structure include an upper steering aperture between the upper radial support wall and the middle radial support and a lower steering aperture between the lower radial support wall and the middle radial support, the upper and lower steering aperture on the port side support structure being the mirror image of the upper and lower steering apertures on the starboard side support structure.

17. A reverse mechanism as recited in claim 16 further comprising:

a port side lateral thrust control wall, the port side lateral thrust control wall extending away from a port edge of the port side deflector towards the fixed horizontal pivot axis and defining the upper and lower steering apertures on the port side support structure in conjunction with the upper radial support wall, the middle radial support and the lower radial support wall of the port side support structure;

a starboard side lateral thrust control wall, the starboard side lateral thrust control wall extending away from a starboard edge of the starboard side deflector surface towards the fixed horizontal pivot axis and defining the upper and lower steering apertures on the starboard side support structure in conjunction with the upper radial support wall, the middle radial support and the lower radial support wall of the starboard side support structure;

wherein the upper and lower steering apertures are sized so that the amount of reverse thrust when the reverse gate is positioned rearward of the rudder does not substantially change as a function of rudder rotation to steer the watercraft.

18. In a jet propelled watercraft having a jet pump and a reverse mechanism comprising:

a stationary nozzle outputting a jet of water rearward of the watercraft to propel the watercraft;

a rudder mounted to rotate about a vertical axis to direct the jet of water from the nozzle and steer the watercraft;

a reverse gate mounted to rotate about a horizontal pivot axis which is stationary with respect to the stationary nozzle, the reverse gate including:

a port side support structure mounted to rotate about the horizontal pivot axis, a starboard side support structure mounted to rotate about the horizontal pivot axis, and a deflector plate that extends at least in part between the port side support structure and the starboard side support structure, the deflector plate having a deflector surface including a vertical jet divide that is located closer to the horizontal pivot axis than the remaining portions of the deflector surface, the vertical jet divide being equally spaced between a port side edge and a starboard side edge of the deflector surface;

a method of steering the watercraft when the reverse gate is rotated into a full-down position rearward of the rudder, the method comprising the steps of:

pivotally lowering the reverse gate so that the deflector plate is rearward of the rudder in a full-down position;

providing reverse thrust by using the deflector plate to deflect a portion of the jet of water from the rudder in a direction substantially forward of the reverse gate; and providing steering thrust by using the deflector plate to laterally deflect another portion of the jet of water from the rudder substantially in the port direction and in the starboard direction proportionally in accordance with the orientation of the rudder;

wherein at least some of the laterally deflected portion of the jet of water is deflected in a direction substantially perpendicular to the direction of the jet of water as the jet of water exits the stationary nozzle, and the amount of reverse thrust when the reverse gate is lowered does not substantially change as a function of rudder rotation to steer the watercraft.

* * * * *

UNITED STATES PATENT AND TRADEMARK OFFICE

CERTIFICATE OF CORRECTION

PATENT NO. : 5,752,864

DATED : May 19, 1998

INVENTOR(S) : JAMES R. JONES ET AL.

It is certified that error appears in the above-indentified patent and that said Letters Patent is hereby corrected as shown below:

In The Claims

Claim 8, Col. 11, Line 46, after "port side" insert ---support---; Claim 12, Col. 12, Line 30, delete "that is secured cable that is reverse gate " and insert ---that is secured to the reverse gate---; Claim 12, Col. 12, Line 33, after "rearward of" insert ---the--- ; Claim 13, Col. 12, Line 45, delete "rotated" and insert ---rotate---; Claim 13, Col. 12, Line 53, after "closer to" insert ---the---; Claim 16, Col. 14, Line 24, after "a lower radial support wall and" insert ---a---; Claim 16, Col. 14, Line 32, delete "aperture" and insert ---apertures---.

Signed and Sealed this

Eighth Day of September, 1998

*Attest:*

Bruce Lehman

BRUCE LEHMAN

*Attesting Officer*

*Commissioner of Patents and Trademarks*